US008090304B2

(12) United States Patent
Baba

(10) Patent No.: US 8,090,304 B2
(45) Date of Patent: Jan. 3, 2012

(54) HEATING DEVICE, FIXING DEVICE AND IMAGE FORMING DEVICE

(75) Inventor: Motofumi Baba, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 581 days.

(21) Appl. No.: 12/336,022

(22) Filed: Dec. 16, 2008

(65) Prior Publication Data

US 2009/0290916 A1 Nov. 26, 2009

(30) Foreign Application Priority Data

May 23, 2008 (JP) ..... 2008-136078

(51) Int. Cl.
*G03G 15/20* (2006.01)

(52) U.S. Cl. ..... 399/329; 399/330; 219/619

(58) Field of Classification Search ..... 399/69, 399/329, 330; 219/619
See application file for complete search history.

(56) References Cited

U.S. PATENT DOCUMENTS

| | | | | |
|---|---|---|---|---|
| 7,778,565 | B2 * | 8/2010 | Baba et al. | 399/69 |
| 2007/0127959 | A1 * | 6/2007 | Tatematsu et al. | 399/329 |
| 2009/0028617 | A1 | 1/2009 | Katakabe et al. | 399/333 |
| 2009/0290917 | A1 * | 11/2009 | Baba et al. | 399/329 |

FOREIGN PATENT DOCUMENTS

| | | |
|---|---|---|
| JP | 11-288190 | 10/1999 |
| JP | 2000-030850 | 1/2000 |
| JP | 2002-182503 | 6/2002 |
| JP | 3527442 B | 2/2004 |
| JP | 2004-177745 | 6/2004 |
| WO | WO 2006/098275 | 9/2006 |

* cited by examiner

*Primary Examiner* — David Gray
*Assistant Examiner* — Laura Roth
(74) *Attorney, Agent, or Firm* — Morgan, Lewis & Bockius LLP

(57) ABSTRACT

A heating device includes: a magnetic field generating unit generating a magnetic field; a heat-generating member generating heat due to electromagnetic induction of the magnetic field, and having a heat-generating layer of a thickness that is thinner than a skin depth; a temperature-sensitive magnetic member including a temperature-sensitive magnetic member whose magnetic permeability starts to decrease continuously from a magnetic permeability change start temperature that is in a temperature region that is greater than or equal to a set temperature and less than or equal to a heat-resistant temperature; and an approaching/separating mechanism maintaining the temperature-sensitive member in a state of being separated from the heat-generating member until before a temperature of the temperature-sensitive member reaches the set temperature, and causing the temperature-sensitive member to contact the heat-generating member at and after the time when the temperature-sensitive member reaches the set temperature.

18 Claims, 12 Drawing Sheets

HEATING DEVICE, FIXING DEVICE AND IMAGE FORMING DEVICE

CROSS-REFERENCE TO RELATED APPLICATION

This application is based on and claims priority under 35 USC 119 from Japanese Patent Application No. 2008-136078 filed on May 23, 2008.

BACKGROUND

1. Technical Field

The present invention relates a heating device, a fixing device and an image forming device.

2. Related Art

Conventionally, there are electromagnetic induction heat-generating type fixing devices that use, as the heat source, a coil that generates a magnetic field by being energized, and a heat-generating body that generates heat by eddy current arising due to electromagnetic induction of the magnetic field.

SUMMARY

A heating device relating to a first aspect of the present invention includes: a magnetic field generating unit that generates a magnetic field; a heat-generating member that is disposed so as to face the magnetic field generating unit and generates heat due to electromagnetic induction of the magnetic field, and has a heat-generating layer of a thickness that is thinner than a skin depth; a temperature-sensitive member that is disposed so as to face a side of the heat-generating member opposite a side at which the magnetic field generating unit is located, and generates heat due to electromagnetic induction of the magnetic field, and includes a temperature-sensitive magnetic member whose magnetic permeability starts to decrease continuously from a magnetic permeability change start temperature that is in a temperature region that is greater than or equal to a set temperature and less than or equal to a heat-resistant temperature; and an approaching separating mechanism that maintains the temperature-sensitive member in a state of being separated from the heat-generating member until before a temperature of the temperature-sensitive member reaches the set temperature, and causes the temperature-sensitive member to contact the heat-generating member at and after the time when the temperature-sensitive member reaches the set temperature.

BRIEF DESCRIPTION OF THE DRAWINGS

Exemplary embodiments of the present invention will be described in detail based on the following figures, wherein.

DETAILED DESCRIPTION

A first exemplary embodiment of a heating device, a fixing device and an image forming device of the present invention will be described on the basis of the drawings.

Figure 1:
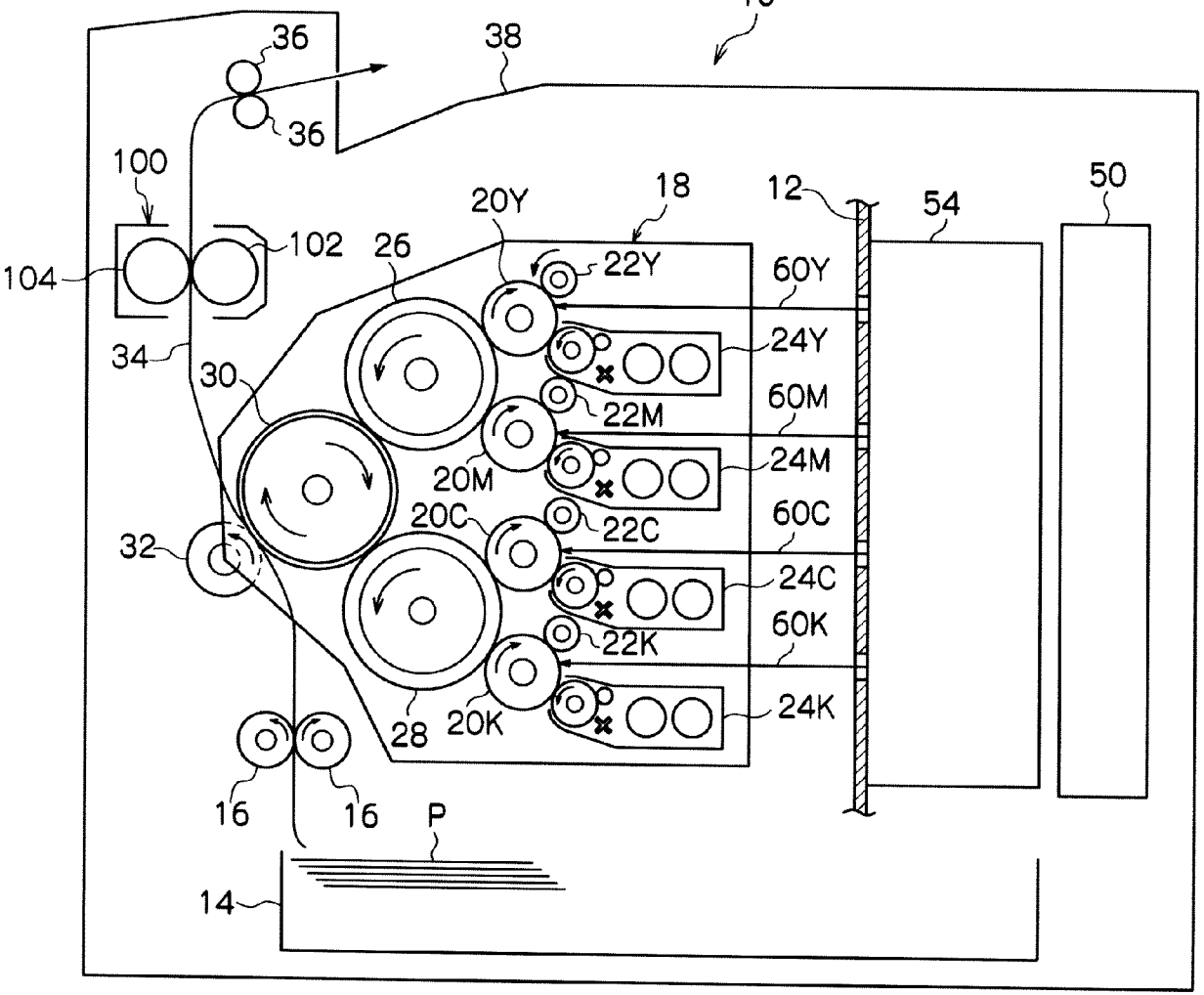
FIG. 1 is an overall view of an image forming device relating to a first exemplary embodiment of the present invention.

A printer 10 serving as an image forming device is shown in FIG. 1. In the printer 10, a light scanning device 54 is fixed to a housing 12 that structures the main body of the printer 10. A control unit 50, that controls the operations of the light scanning device 54 and each of the sections of the printer 10, is provided at a position adjacent to the light scanning device 54.

In the light scanning device 54, a light beam that exits from an unillustrated light source is scanned at a rotating polygon mirror and reflected by plural optical parts such as reflecting mirrors and the like, and light beams 60Y, 60M, 60C, 60K corresponding to respective toners of yellow (Y), magenta (M), cyan (C) and black (K) exit. The light beams 60Y, 60M, 60C, 60K are guided to photoconductive bodies 20Y, 20M, 20C, 20K, respectively.

A sheet tray 14 that accommodates recording sheets P is provided at the lower side of the printer 10. A pair of registration rollers 16, that adjust the position of the leading end portion of the recording sheet P, are provided above the sheet tray 14. An image forming unit 18 is provided at the central portion of the printer 10. The image forming unit 18 is equipped with the four photoconductive bodies 20Y, 20M, 20C, 20K, and they are lined up in a row vertically.

Charging rollers 22Y, 22M, 22C, 22K, that charge the surfaces of the photoconductive bodies 20Y, 20M, 20C, 20K, are provided at the upstream sides in the directions of rotation of the photoconductive bodies 20Y, 20M, 20C, 20K. Developing units 24Y, 24M, 24C, 24K, that develop the toners of Y, M, C, K on the photoconductive bodies 20Y, 20M, 20C, 20K respectively, are provided at the downstream sides in the directions of rotation of the photoconductive bodies 20Y, 20M, 20C, 20K.

A first intermediate transfer body 26 contacts the photoconductive bodies 20Y, 20M, and a second intermediate transfer body 28 contacts the photoconductive bodies 20C, 20K. A third intermediate transfer body 30 contacts the first intermediate transfer body 26 and the second intermediate transfer body 28. A transfer roller 32 is provided at a position opposing the third intermediate transfer body 30. Due thereto, the recording sheet P is transported between the transfer roller 32 and the third intermediate transfer body 30, and the toner image on the third intermediate transfer body 30 is transferred onto the recording sheet P.

A fixing device 100 is provided downstream of a sheet transporting path 34 on which the recording sheet P is transported. The fixing device 100 has a fixing belt 102 and a pressure roller 104. The recording sheet P is heated and pressure is applied thereto, and the toner image is fixed on the recording sheet P. The recording sheet P on which the toner image is fixed is discharged-out by sheet transporting rollers 36 to a tray 38 provided at the top portion of the printer 10.

Image formation of the printer 10 will be described next.

When image formation is started, the surfaces of the respective photoconductive bodies 20Y through 20K are charged uniformly by the charging rollers 22Y through 22K. Then, the light beams 60Y through 60K that correspond to the output image are illuminated from the light scanning device 54 onto the charged surfaces of the photoconductive bodies 20Y through 20K, and electrostatic latent images corresponding to respective color separation images are formed on the photoconductive bodies 20Y through 20K. The developing units 24Y through 24K selectively apply toners of the respective colors, i.e., Y through K, onto the electrostatic latent images, such that toner images of the colors Y through K are formed on the photoconductive bodies 20Y through 20K.

Thereafter, the magenta toner image is primarily transferred from the photoconductive body 20M for magenta to the first intermediate transfer body 26. Further, the yellow toner image is primarily transferred from the photoconductive body 20Y for yellow to the first intermediate transfer body 26, and is superposed on the magenta toner image on the first intermediate transfer body 26.

Similarly, the black toner image is primarily transferred from the photoconductive body 20K for black to the second intermediate transfer body 28. Further, the cyan toner image is primarily transferred from the photoconductive body 20C for cyan to the second intermediate transfer body 28, and is superposed on the black toner image on the second intermediate transfer body 28.

The magenta and yellow toner images, that were primarily transferred onto the first intermediate transfer body 26, are secondarily transferred onto the third intermediate transfer body 30. On the other hand, the black and cyan toner images, that were primarily transferred onto the second intermediate transfer body 28, also are secondarily transferred onto the third intermediate transfer body 30. Here, the magenta and yellow toner images, that were secondarily-transferred previously, and the cyan and black toner images, are superposed on one another, such that a full color toner image of colors (three colors) and black is formed on the third intermediate transfer body 30.

The full color toner image that is secondarily transferred reaches the nip portion between the third intermediate transfer body 30 and the transfer roller 32. Synchronously with the timing thereof, the recording sheet P is transported from the registration rollers 16 to the nip portion, and the full color toner image is tertiarily transferred onto the recording sheet P (final transfer).

Thereafter, the recording sheet P is sent to the fixing device 100, and passes-through the nip portion between the fixing belt 102 and the pressure roller 104. At this time, due to the working of the heat and the pressure provided from the fixing belt 102 and the pressure roller 104, the full color toner image is fixed on the recording sheet P. After fixing, the recording sheet P is discharged-out to the tray 38 by the sheet transporting rollers 36, and the formation of a full color image onto the recording sheet P ends.

The fixing device 100 relating to the present exemplary embodiment will be described next. Note that, in the present exemplary embodiment, the heat-resistant temperature of the fixing device 100 is set to 240° C., and the set fixing temperature is set to 170° C.

Figure 2A:
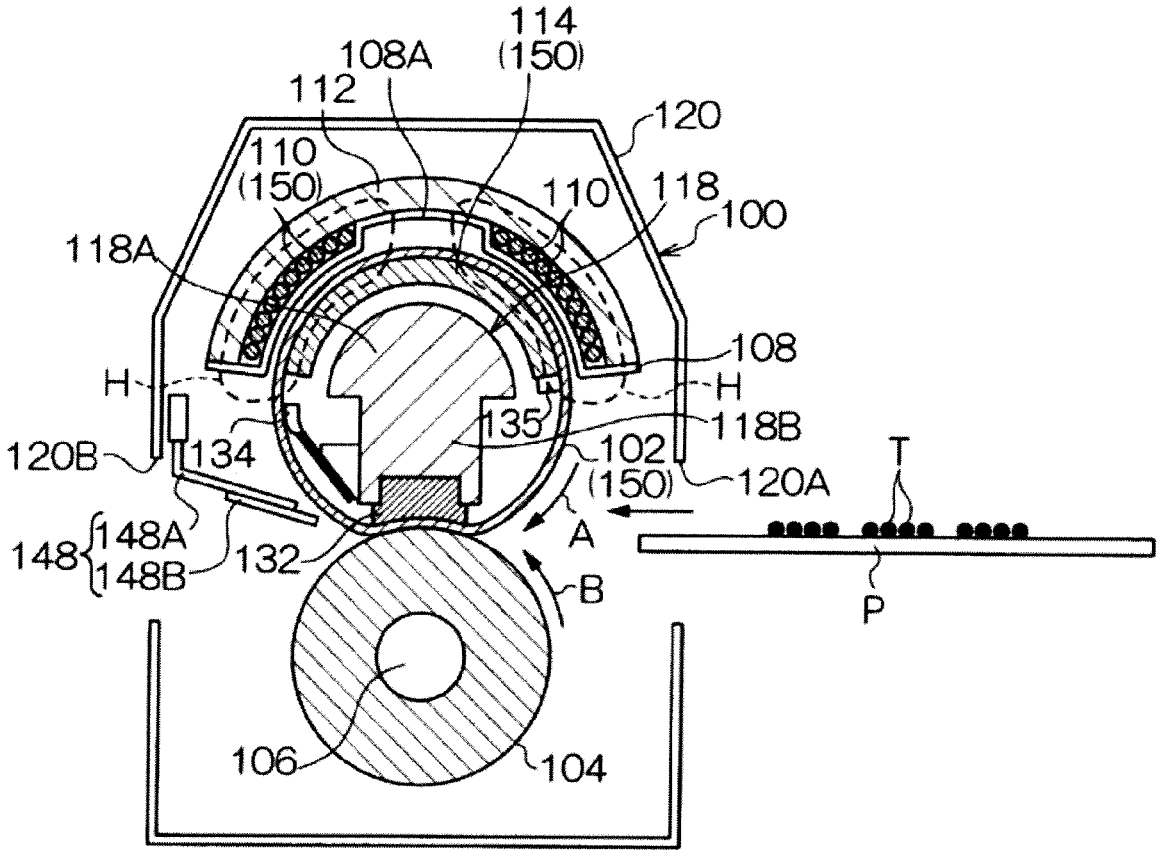
FIG. 2A and FIG. 2B are cross-sectional views of a fixing device relating to the first exemplary embodiment of the present invention.

As shown in FIG. 2A, the fixing device 100 has a housing 120 in which are formed openings 120A, 120B for carrying out entry and discharging of the recording sheet P. The fixing belt 102 that is endless is provided at the interior of the housing 120. Cap members (not shown), that are shaped as cylindrical tubes and have rotating shafts, are fit-together with and fixed to the both end portions of the fixing belt 102, such that the fixing belt 102 is supported so as to be able to rotate around these rotating shafts. Further, a gear, that is connected to a motor (not shown) that rotates and drives the fixing belt 102, is adhered to one of the cap members. Here, when the motor operates, the fixing belt 102 rotates in the direction of arrow A.

A bobbin 108, that is structured by an insulating material, is disposed at a position opposing the outer peripheral surface of the fixing belt 102. The bobbin 108 is formed substantially in the shape of an arc that follows the outer peripheral surface of the fixing belt 102. A convex portion 108A is provided so as to project-out from the substantially central portion of the surface of the bobbin 108 at the side opposite the side at which the fixing belt 102 is located. The gap between the bobbin 108 and the fixing belt 102 is around 1 to 3 mm.

An excitation coil 110, that generates a magnetic field H by being energized, is wound plural times in the axial direction (the direction perpendicular to the surface of the drawing of FIG. 2A) around the convex portion 108A. A magnetic body core 12, that is formed in a substantial arc shape following the arc shape of the bobbin 108, is disposed at a position opposing the excitation coil 110, and is supported by the bobbin 108 or the excitation coil 110.

The structure of the fixing belt 102 will be described next.

Figure 3A:
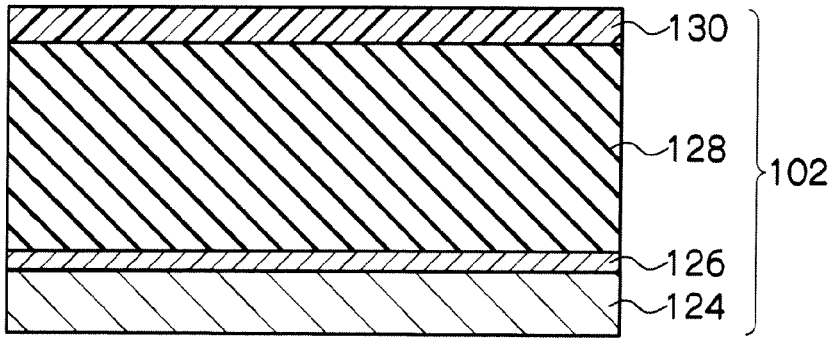
FIG. 3A is a cross-sectional view of a fixing belt relating to the first exemplary embodiment of the present invention.

As shown in FIG. 3A, the fixing belt 102 is structured by a base layer 124, a heat-generating layer 126, an elastic layer 128 and a releasing layer 130 from the inner side toward the outer side thereof. These layers are laminated together and made integral. Further, the diameter of the fixing belt 102 is 30 mm, and the transverse direction length thereof is 370 mm.

The base layer 124 has strength to support the thin heat-generating layer 126 and is heat-resistant. A material that, while a magnetic field (magnetic flux) passes therethrough, either does not generate heat or at which it is difficult for heat to be generated due to the working of the magnetic field, can be appropriately selected as the base layer 124. A metal belt (as a non-magnetic metal, non-magnetic stainless steel for example) of a thickness of 30 to 200 μm (preferably 100 to 150 μm), a belt structured by a metal material formed from Fe, Ni or magnetic alloys thereof such as Fe—Ni or the like, a resin belt (e.g., a polyimide belt) of a thickness of 60 to 200 μm, and the like are examples. In any case, the material (the specific resistance, the relative magnetic permeability) and the thickness are appropriately set such that the magnetic flux of the excitation coil 110 works to a temperature-sensitive member. In the present exemplary embodiment, non-magnetic stainless is used.

The heat-generating layer 126 is structured by a metal material that generates heat due to the working of electromagnetic induction in which eddy current flows so as to generate a magnetic field that cancels the aforementioned magnetic field H. In order for the magnetic flux of the magnetic field H to pass-through, the heat-generating layer 126 must be structured to be thinner than a skin depth that is the thickness that the magnetic field H can penetrate. Here, given that the skin depth is δ, the specific resistance of the heat-generating layer 126 is $\rho_n$, the relative magnetic permeability is $\mu_n$, and the frequency of the signal (current) at the excitation coil 110 is f, δ is expressed by formula (1).

[Formula 1]

$$\delta_n = 503\sqrt{\frac{\rho_n}{f \cdot \mu_n}} \quad (1)$$

For example, gold, silver, copper, aluminum, zinc, tin, lead, bismuth, beryllium, antimony, or a metal material that is an alloy thereof can be used as the metal material that is used for the heat-generating layer 126. Note that it is better to make the thickness of the heat-generating layer 126 as thin as possible also in order to shorten the warm-up time of the fixing device 100.

Here, in a range of AC frequency of 20 kHz to 100 kHz that a general-use power source can utilize, it is preferable to use, as the heat-generating layer 126, a non-magnetic metal (a paramagnetic body whose relative magnetic permeability is about 1) material whose thickness is 2 to 20 μm and whose specific resistance is less than or equal to $2.7\times10^{-8}$ Ωcm. Therefore, in the present exemplary embodiment, copper of a thickness of 10 μm is used as the heat-generating layer 126 from the standpoint of being able to efficiently obtain the needed heat generation amount, and also from the standpoint of low cost.

From the standpoint of obtaining excellent elasticity and heat resistance, and the like, a silicon rubber or a fluorine rubber is used as the elastic layer 128. In the present exemplary embodiment, silicon rubber is used. Further, the thickness of the elastic layer 128 in the present exemplary embodiment is 200 μm. Note that it is preferable to set the thickness of the elastic layer 128 within 200 μm to 600 μm.

The releasing layer 130 is provided in order to weaken the adhesive force with the toner T (see FIG. 2A) that is fused on the recording sheet P, and make the recording sheet P peel-away easily from the fixing belt 102. In order to obtain excellent surface releasability, a fluorine resin, silicon resin, or polyimide resin is used as the releasing layer 130, and PFA (tetrafluoroethylene-perfluoroalkoxyethylene copolymer resin) is used in the present exemplary embodiment. The thickness of the releasing layer 130 is 30 μm.

On the other hand, as shown in FIG. 2A, a temperature-sensitive magnetic member 114, that is substantially shaped as an arcuate plate and that contacts the inner peripheral surface of the fixing belt 102, is provided so as to follow the fixing belt 102. The temperature-sensitive magnetic member 114 is disposed so as to face the excitation coil 110.

Figure 4A:
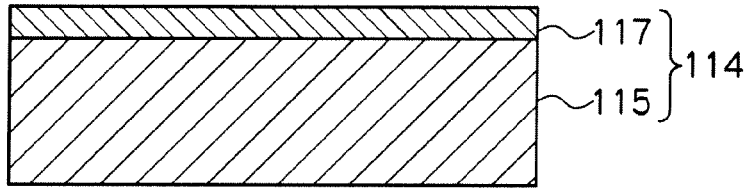
FIG. 4A is a cross-sectional view of a temperature-sensitive magnetic member relating to the first exemplary embodiment of the present invention.

As shown in FIG. 4A, the temperature-sensitive magnetic member 114 has a temperature-sensitive layer 115 that is the base layer and has a temperature-sensitive characteristic that will be described hereinafter, and a heat-generating layer 117 that is layered and formed on the surface of the temperature-sensitive layer 115.

The temperature-sensitive layer 115 is structured of a material having a temperature-sensitive characteristic that is such that the magnetic permeability starts to continuously decrease from a magnetic permeability change start temperature that is in a temperature region that is greater than or equal to the set fixing (heating) temperature of the fixing belt 102 and less than or equal to the heat-resistant temperature of the fixing belt 102. Concretely, a magnetic shunt steel, an amorphous alloy or the like is used. It is preferable to use a metal alloy material formed from Fe, Ni, Si, B, Nb, Cu, Zr, Co, Cr, V, Mn, Mo or the like, for example, a binary magnetic shunt steel such as Fe—Ni or a ternary magnetic shunt steel such as Fe—Ni—Cr. In the present exemplary embodiment, 36 Ni—Fe temperature-sensitive magnetic alloys of a thickness of 150 μm is used.

Here, the heat-generating layer 117 is provided at the temperature-sensitive magnetic member 114. However, the heat-generating layer 117 is unnecessary in cases in which the needed heat generation amount is obtained even with only the temperature-sensitive magnetic member 114 if the heat-generating layer 117 is not provided.

Further, in a case in which the heat generation amount is too large even with only the temperature-sensitive magnetic member 114, it suffices to provide a structure that divides the main path of the eddy current that flows to the temperature-sensitive magnetic member 114, in order to suppress heat generation of the temperature-sensitive magnetic member 114. Specifically, it suffices to make it difficult for eddy current to flow by providing plural slits so that the appropriate heat generation amount is obtained. The heat generation amount can be appropriately adjusted by appropriately varying the numbers, the widths, the lengthwise positions, and the like of the slits. Slits are effective when formed in a direction substantially perpendicular to the main path of the flow of the eddy current.

Further, a non-magnetic metal layer, that is a non-magnetic metal material having a low specific resistance, may be disposed at the surface of the temperature-sensitive magnetic member 114 which surface is at the side opposite the excitation coil 110. Because the non-magnetic metal layer has the effect of making the axial direction temperature distribution of the temperature-sensitive magnetic member 114 uniform, it can suppress local rises in temperature. Further, in cases in which the temperature of the temperature-sensitive layer 115 rises and, at or exceeding the magnetic permeability change start temperature, the magnetic permeability continuously decreases, the heat generation amount of the heat-generating layer 117 and the temperature-sensitive layer 115 can be suppressed by a large amount of the magnetic flux working on the non-magnetic metal layer. Note that this effect is the same as the effect that an induction body 118 brings about.

Silver, copper and aluminum are suitable as the material of the non-magnetic metal layer, and aluminum is optimal from the standpoint of material cost. The temperature-sensitive magnetic member 114 and the non-magnetic metal layer may be joined by cladding or the like, or may be supported merely in an accompanying state so that the contact surfaces follow the respective plate-shape layers, or the like.

A material having a characteristic that is similar to the above-described heat-generating layer 126 of the fixing belt 102 is used as the heat-generating layer 117. In the present exemplary embodiment, copper of a thickness of 20 μm is used as the heat-generating layer 117. Note that, as shown in FIG. 2A, a temperature sensor 135, that senses the temperature of the temperature-sensitive magnetic member 114, is provided at one end in the transverse direction (the direction of the arc) of the temperature-sensitive magnetic member 114.

Figure 4B:
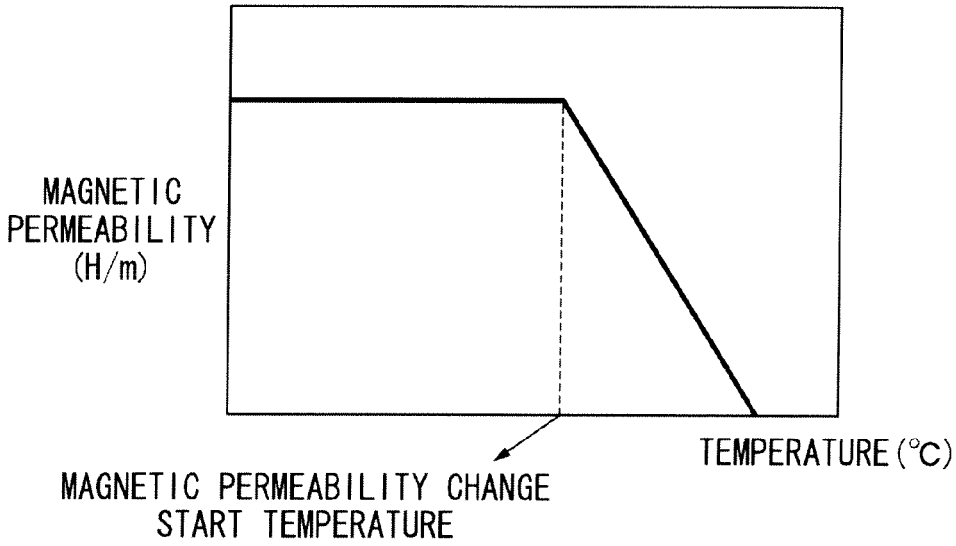
FIG. 4B is a schematic drawing showing the relationship between magnetic permeability and temperature of the temperature-sensitive magnetic member relating to the first exemplary embodiment of the present invention.

As shown in FIG. 4B, the magnetic permeability change start temperature is the temperature at which the magnetic permeability (measured in accordance with JIS C2531) starts to decrease continuously, and is the point where the pass-through amount of the magnetic flux of the magnetic field starts to change. Further, the magnetic permeability change start temperature is different than the Curie point, and is preferably set to 150° C. to 230° C.

On the other hand, as shown in FIG. 2A, the induction body 118 that is formed from aluminum is provided at the inner side of the temperature-sensitive magnetic member 114. The induction body 118 has a thickness that is greater than or equal to the skin depth, and is desirably a non-magnetic metal of a small specific resistance. Silver, copper and aluminum are suitable as the material thereof. If any of these materials are selected and made to be a thickness that is greater than or equal to the skin depth, when a magnetic field works on the induction body 118, it is easy for eddy current to flow from the heat-generating layer 117, and even when eddy current flows, the eddy current loss is extremely small as compared with the heat-generating layer 117. The induction body 118 is structured by an arc portion 118A that faces the inner peripheral surface of the temperature-sensitive magnetic member 114, and a column portion 118B formed integrally with the arc portion 118A. Both ends of the induction body 118 are fixed to the housing 120 of the fixing device 100.

The arc portion 118A of the induction body 118 is disposed in advance at a position at which, when the magnetic flux of the magnetic field H passes-through the temperature-sensitive magnetic member 114, the arc portion 118A induces the magnetic flux of the magnetic field H so as to form a closed magnetic path. The induction body 118 and the temperature-sensitive magnetic member 114 are separated by 1 to 5 mm. Note that, as will be described later, the induction body 118 and the temperature-sensitive magnetic member 114 are supported independently.

A pushing pad 132, that is for pushing the fixing belt 102 toward the outer side at a predetermined pressure, is fixed to and supported at the end surface of the column portion 118B of the induction body 118. Due thereto, there is no need to provide members that respectively support the induction body 118 and the pushing pad 132, and the fixing device 100 can be made to be compact. The pushing pad 132 is formed by a member that is elastic such as urethane rubber, sponge or the like. One end surface of the pushing pad 132 contacts the inner peripheral surface of the fixing belt 102 and pushes the fixing belt 102.

The induction body 118 may be structured so as to be supported by a supporting body that is a separate member. In this case, for example, there may be a structure in which an induction body 118C, that is formed in the shape of a curved plate from a non-magnetic metal having a low specific resistance, is provided so as to be interposed between the temperature-sensitive magnetic member 114 and a supporting body 123, as shown in FIG. 2C. The supporting body 123 is a member for supporting the load from the pressure roller 104, and preferably is rigid with little flexure.

It suffices for the thickness of the induction body 118C to be greater than or equal to at least the skin depth of the non-magnetic metal used at the induction body 118C, and to be a thickness such that, even if the temperature-sensitive magnetic member 114 becomes non-magnetic and magnetic flux can pass therethrough, a magnetic path of the magnetic field H can be formed so that hardly any of the magnetic flux can pass-through the induction body 118C. In the present invention, aluminum of a thickness of 1 mm is used and is a thickness that is greater than or equal to the skin depth. Therefore, the supporting body 123 may be structured by a magnetic metal such as an inexpensive sheet metal or the like, and the degrees of freedom in selecting the material in the design increase. Because the magnetic field can be soundly shielded by the induction body 118C, the supporting body 123 is hardly heated at all by electromagnetic induction, and wasteful eddy current loss can be prevented.

The pressure roller 104, that slave-rotates in the direction of arrow B (the direction opposite the direction of arrow A) with respect to the rotation of the fixing belt 102, press-contacts the outer peripheral surface of the fixing belt 102.

The pressure roller 104 is structured such that a foamed silicon rubber sponge elastic layer of a thickness of 5 mm is provided at the periphery of a core metal 106 that is formed from a metal such as aluminum or the like, and the outer side of this foamed silicon rubber sponge elastic layer is covered by a releasing layer formed from carbon-containing PFA of a thickness of 50 μm. Further, the pressure roller 104 can contact or move away from the outer peripheral surface of the fixing belt 102 by a retracting mechanism in which an unillustrated bracket, that rotatably supports the pressure roller 104, swings by a cam.

A thermistor 134, that measures the temperature of the inner peripheral surface of the fixing belt 102, is provided so as to contact a region at the inner side of the fixing belt 102 which region does not face the excitation coil 110 and is at the discharging side of the recording sheet P. The thermistor 134 measures the surface temperature of the fixing belt 102 by temperature-converting the resistance value that varies in accordance with the heat amount provided from the fixing belt 102. The position of contact of the thermistor 134 is a substantially central portion in the transverse direction of the fixing belt 102, such that the measured value does not change in accordance with the magnitude of the size of the recording sheet P.

Figure 3B:
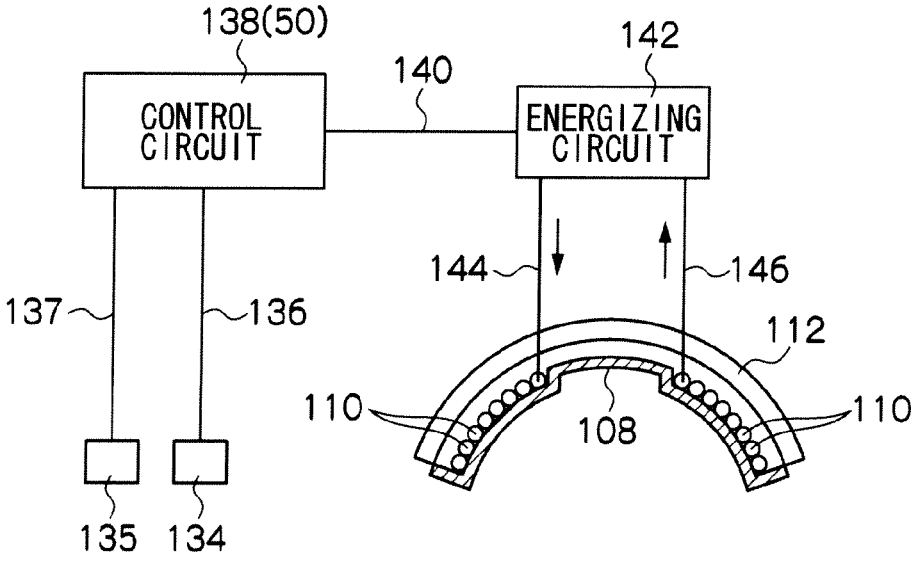
FIG. 3B is a connection diagram of a control circuit and an energizing circuit relating to the first exemplary embodiment of the present invention.

As shown in FIG. 3B, the thermistor 134 is connected, via a wire 136, to a control circuit 138 provided at the interior of the aforementioned control unit 50 (see FIG. 1). Similarly, the temperature sensor 135 is connected to the control circuit 138 via a wire 137.

The control circuit 138 is connected to an energizing circuit 142 via a wire 140. The energizing circuit 142 is connected to the aforementioned excitation coil 110 via wires 144, 146. The energizing circuit 142 is driven or the driving thereof is stopped on the basis of electric signals sent from the control circuit 138. The energizing circuit 142 supplies (in the directions of the arrows) or stops the supply of AC current of a predetermined frequency to the excitation coil 110 via the wires 144, 146.

Here, the control circuit 138 carries out temperature conversion on the basis of an electrical amount sent from the thermistor 134, and measures the temperature of the surface of the fixing belt 102. Then, the control circuit 138 compares this measured temperature and a set fixing temperature that is stored in advance (170° C. in the present exemplary embodiment). If the measured temperature is lower than the set fixing temperature, the control circuit 138 drives the energizing circuit 142 and energizes the excitation coil 110, and causes the magnetic field H (see FIG. 2A) serving as a magnetic circuit to be generated. If the measured temperature is higher than the set fixing temperature, the control circuit 138 stops the energizing circuit 142.

Further, the control circuit 138 carries out temperature-conversion on the basis of an electrical amount sent from the temperature sensor 135, and measures the temperature of the temperature-sensitive magnetic member 114. Then, the control unit 50 compares this measured temperature and a reference set temperature of the temperature-sensitive magnetic member 114 that is stored in advance (e.g., 180° C.). If the measured temperature is lower than the reference set temperature, the control unit 50 carries out control so as to make the temperature-sensitive magnetic member 114 not contact the fixing belt 102.

As shown in FIG. 2A, a peeling member 148 is provided in a vicinity of the recording sheet P transporting direction downstream side of the contact portion (nip portion) of the fixing belt 102 and the pressure roller 104. The peeling member 148 is structured by a supporting portion 148A whose one end is fixed, and a peeling sheet 148B supported at the supporting portion 148A. The distal end of the peeling sheet 148B is disposed so as to be adjacent to or contact the fixing belt 102.

The mechanism for causing the temperature-sensitive magnetic member 114 to approach and move away from the fixing belt 102 will be described next.

Figure 5:
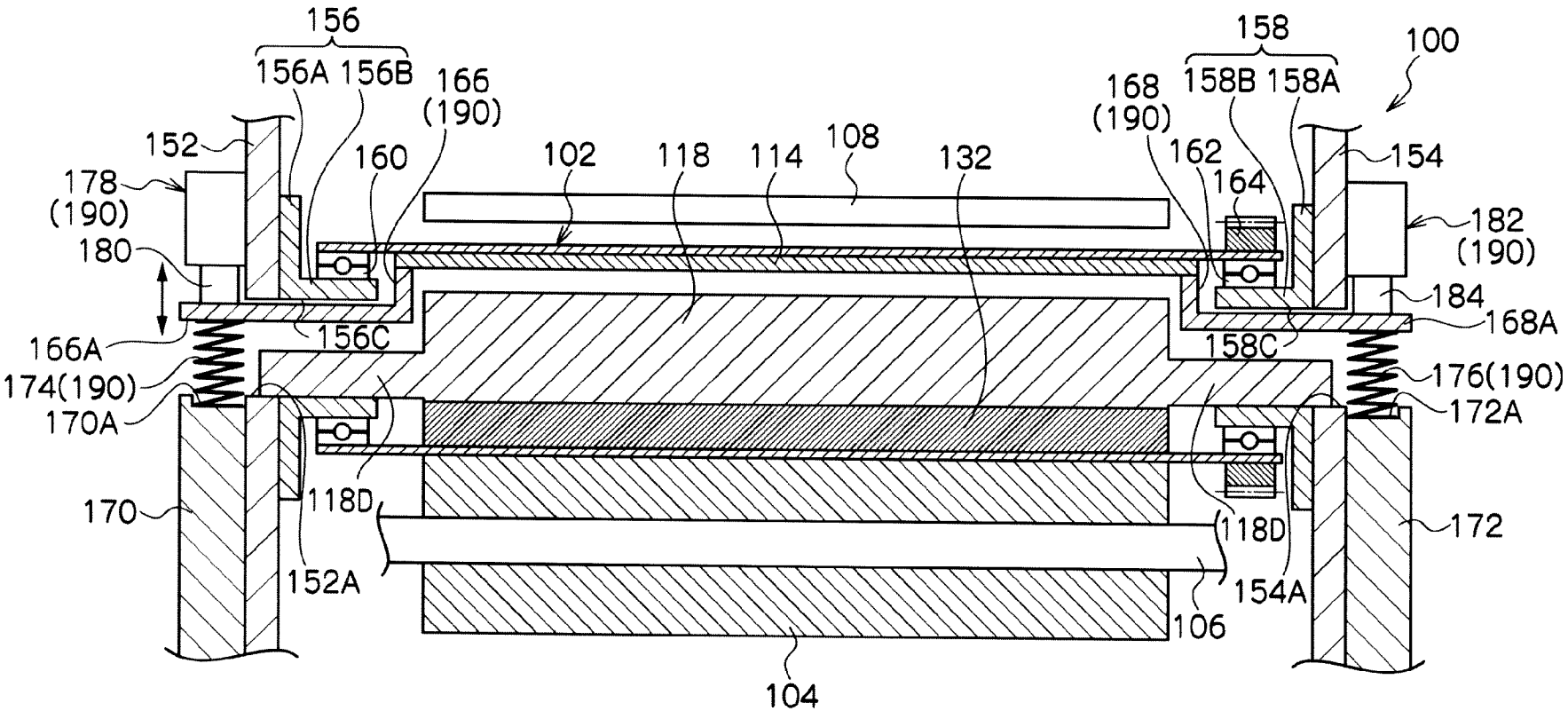
FIG. 5 is a cross-sectional view showing an approaching/separating mechanism section relating to the first exemplary embodiment of the present invention.

As shown in FIG. 5, a pair of side plates 152, 154 stand erect at the interior of the fixing device 100 so as to sandwich the both end portions of the fixing belt 102 and the pressure roller 104. Through-holes 152A, 154A, whose diameters are smaller than the inner diameter of the fixing belt 102, are formed in positions of the side plates 152, 154 which positions face the both end portions of the fixing belt 102.

Supporting members 156, 158 are provided at the inner walls of the side plate 152 and the side plate 154, respectively, by unillustrated fixing members such as screws or the like. The supporting member 156 is structured by a flat plate portion 156A that is fixed to the side plate 152, a shaft portion 156B that is shaped as a cylindrical tube and projects-out from the flat plate portion 156A, and a through-hole 156C that passes-through the flat plate portion 156A and the shaft portion 156B.

Similarly, the supporting member 158 is structured by a flat plate portion 158A that is fixed to the side plate 154, a shaft portion 158B that is shaped as a cylindrical tube and projects-out from the flat plate portion 158A, and a through-hole 158C that passes-through the flat plate portion 158A and the shaft portion 158B.

The through-hole 152A and the through-hole 156C are the same diameter, and are in a communicating state in which the inner peripheral walls thereof coincide. Similarly, the through-hole 154A and the through-hole 158C are the same diameter, and are in a communicating state in which the inner peripheral walls thereof coincide.

A bearing 160 is fit on the exterior of the shaft portion 156B, a bearing 162 is fit on the exterior of the shaft portion 158B, and both are fixed. Here, the outer diameters of the bearings 160, 162 are substantially the same as the inner diameter of the fixing belt 102. The inner peripheral surface of the both end portions of the fixing belt 102 is adhered and fixed to the outer peripheral surfaces of the bearings 160, 162. The fixing belt 102 can thereby rotate with the centers of the shaft portions 156B, 158B being the center of rotation.

A gear 164 for rotating driving is mounted to the outer peripheral surface of the one end of the fixing belt 102 at the shaft portion 158B side. The gear 164 is driven by an unillustrated motor that is operated and controlled by the aforementioned control unit 50 (see FIG. 1).

On the other hand, one ends of supporting members 166, 168, that are substantially L-shaped in cross-section respectively, are adhered to the both end portions of the temperature-sensitive magnetic member 114. A flat plate portion 166A and a flat plate portion 168A are formed at the other end sides of the supporting members 166, 168. Note that the supporting members 166, 168 are structured by members having low heat conductivity, and the heat of the temperature-sensitive magnetic member 114 is not transferred as is to the supporting members 166, 168.

The flat plate portion 166A is inserted-through the through-hole 156C and the through-hole 152A, and projects-out further toward the outer side than the side plate 152. Similarly, the flat plate portion 168A is inserted-through the through-hole 158C and the through-hole 154A, and projects-out further toward the outer side than the side plate 154.

A base 170, that is wide and at whose top surface a recess 170A is formed, is provided beneath the flat plate portion 166A. The base 170 is fixed to the outer wall of the side plate 152. The recess 170A is at a position opposing the end portion of the flat plate portion 166A of the supporting member 166.

Similarly, a base 172, that is wide and at whose top surface a recess 172A is formed, is provided beneath the flat plate portion 168A. The base 172 is fixed to the outer wall of the side plate 154. The recess 172A is at a position opposing the end portion of the flat plate portion 168A of the supporting member 168.

Here, one end of a coil spring 174 is fixed to the recess 170A, and the other end of the coil spring 174 is fixed to the bottom surface of the flat plate portion 166A. Similarly, one end of a coil spring 176 is fixed to the recess 172A, and the other end of the coil spring 176 is fixed to the bottom surface of the flat plate portion 168A. Due thereto, the temperature-sensitive magnetic member 114 is supported so as to be movable in the vertical direction.

Note that, in the state (at the position) in which the coil springs 174, 176 extend completely the temperature-sensitive magnetic member 114 contacts the inner peripheral surface of the fixing belt 102. The fixing belt 102 is not deformed outwardly by the temperature-sensitive magnetic member 114 due thereto.

An electric cylinder 178 is provided at a position opposing the coil spring 174, above the flat plate portion 166A. The electric cylinder 178 has a cylinder (movable member) 180 that can be projected or housed from one side of the electric cylinder 178. The electric cylinder 178 is fixed to the outer wall of the side plate 152 such that the cylinder 180 is directed downward.

Similarly, an electric cylinder 182 is provided at a position opposing the coil spring 176, above the flat plate portion 168A. The electric cylinder 182 has a cylinder (movable member) 184 that can be projected or housed from one side of the electric cylinder 182. The electric cylinder 182 is fixed to the outer wall of the side plate 154 such that the cylinder 184 is directed downward.

In the state in which the cylinder 180 is housed and short, the end surface thereof slightly contacts the top surface of the flat plate portion 166A. Similarly, in the state in which the cylinder 184 is housed and short, the end surface thereof slightly contacts the top surface of the flat plate portion 168A. At both of the electric cylinders 178, 182, the operations of extending and drawing-in the cylinders 180, 184 are carried out by the aforementioned control unit 50 (see FIG. 1).

An approaching separating mechanism section 190 of the temperature-sensitive magnetic member 114 is structured by the electric cylinders 178, 182, the supporting members 166, 168 and the coil springs 174, 176. Further, at the fixing device 100, a heating section 150 serving as a heating device is structured by the excitation coil 110, the fixing belt 102, the temperature-sensitive magnetic member 114, and the approaching/separating mechanism section 190.

Before the temperature of the fixing belt 102 reaches the set fixing temperature, the control unit 50 carries out operation and control of the electric cylinders 178, 182 so as to extend the cylinders 180, 184. Then, after the temperature of the fixing belt 102 has reached the set fixing temperature, when the temperature falls from the set fixing temperature, the control unit 50 carries out operation and control of the electric cylinders 178, 182 so as to draw-in the cylinders 180, 184.

Note that, when the temperature of the temperature-sensitive magnetic member 114 that is sensed by the temperature sensor 135 is lower than the reference set temperature, the control unit 50 does not operate the electric cylinders 178, 182, and the temperature-sensitive magnetic member 114 and the fixing belt 102 are maintained in the separated state.

On the other hand, shaft portions 118D project-out from the both end portions of the above-described induction body 118. The shaft portions 118D are adhered and fixed to the inner walls of the through-hole 152A and the through-hole 156C, and the inner walls of the through-hole 154A and the through-hole 158C, respectively.

Operation of the first exemplary embodiment of the present invention will be described next. First, the fixing operation of the fixing device 100 will be described.

Figure 6A:
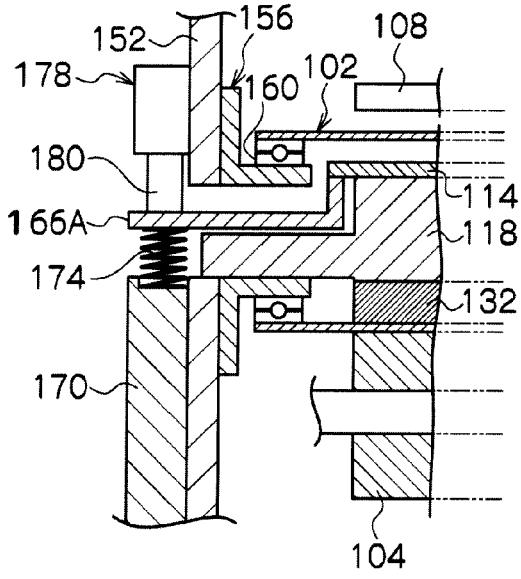
FIG. 6A and FIG. 6B are partial sectional views showing operation of the approaching/separating mechanism section relating to the first exemplary embodiment of the present invention.

As shown in FIG. 1, the recording sheet P, on which the toner T has been transferred through the above-described image forming processes of the printer 10, is sent to the fixing device 100. At this time, as shown in FIG. 6A and FIG. 6C, the cylinder 180 (and the cylinder 184) are in states of extending downward. Therefore, the flat plate portion 166A (and the flat plate portion 168A) are pushed downward, the coil spring 174 (and the coil spring 176) contract, and the temperature-sensitive magnetic member 114 is in a state of not contacting the inner peripheral surface of the fixing belt 102.

Next, as shown in FIG. 2A, FIG. 3A and FIG. 3B, at the fixing device 100, the driving motor (not shown) is driven by the control unit 50, and the fixing belt 102 rotates in the direction of arrow A. At this time, the energizing circuit 142 is driven on the basis of the electric signal from the control circuit 138, and AC current is supplied to the excitation coil 110.

When AC current is supplied to the excitation coil 110, generation and extinction of the magnetic field H serving as a magnetic circuit are repeated at the periphery of the excitation coil 110. Then, when the magnetic field H traverses the heat-generating layer 126 of the fixing belt 102, eddy current is generated at the heat-generating layer 126 such that a magnetic field that impedes changes in the magnetic field H arises.

The heat-generating layer 126 generates heat in proportion to the magnitudes of the surface skin resistance of the heat-generating layer 126 and the eddy current flowing through the heat-generating layer 126, and the fixing belt 102 is heated thereby. Here, the fixing belt 102 is in a state of not contacting the temperature-sensitive magnetic member 114, and it is difficult for the heat for raising the temperature of the fixing belt 102 to be robbed by the temperature-sensitive magnetic member 114. Therefore, raising of the temperature of the fixing belt 102 is carried out in a short time period.

Note that, at this time, because the magnetic field H penetrates to the heat-generating layer 117 (see FIG. 4A) of the temperature-sensitive magnetic member 114, the heat-generating layer 117 (and the temperature-sensitive magnetic member 114) also generate heat. However, because the fixing belt 102 and the temperature-sensitive magnetic member 114 are in a non-contact state, the temperature-sensitive magnetic member 114 hardly affects the temperature of the fixing belt 102 at all. Due thereto, excessive raising of the temperature of the fixing belt 102 is suppressed.

Next, the temperature of the surface of the fixing belt 102 is sensed at the thermistor 134, and if it has not reached the set fixing temperature of 170° C., the control circuit 138 drives and controls the energizing circuit 142, and supplies AC current of a predetermined frequency to the excitation coil 110. Further, in a case in which the temperature of the surface of the fixing belt 102 has reached the set fixing temperature, the control circuit 138 stops control of the energizing circuit 142.

At the stage when the fixing belt 102 reaches the set fixing temperature, the control unit 50 operates the retracting mechanism and makes the pressure roller 104 contact the fixing belt 102. Then, the pressure roller 104 rotates in the direction of arrow B together with the fixing belt 102 that rotates.

Next, as shown in FIG. 1 and FIG. 2A, the recording sheet P that is sent into the fixing device 100 is heated and pressed by the fixing belt 102 that has become the predetermined set fixing temperature (170° C.) and the pressure roller 104, such that the toner image is fixed on the surface of the recording sheet P. The recording sheet P, that is discharged from the fixing device 100, is discharged-out to the tray 38 by the sheet transporting rollers 36.

In this way, after the fixing of the first recording sheet P, the heat of the high-temperature fixing belt 102 is robbed by the low-temperature recording sheet P, and therefore, the temperature of the fixing belt 102 falls.

Figure 6B:
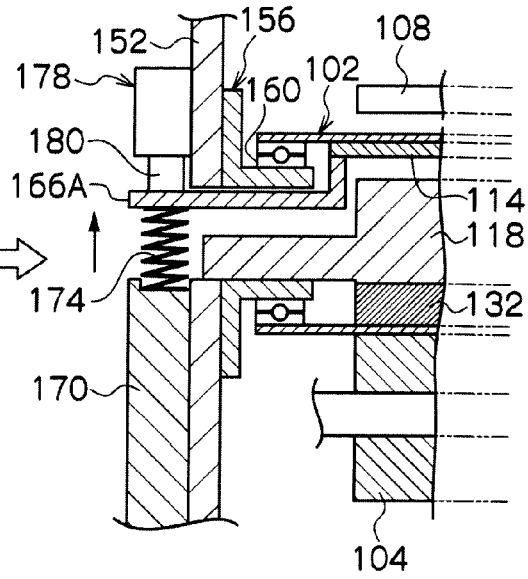
Figure 6C:
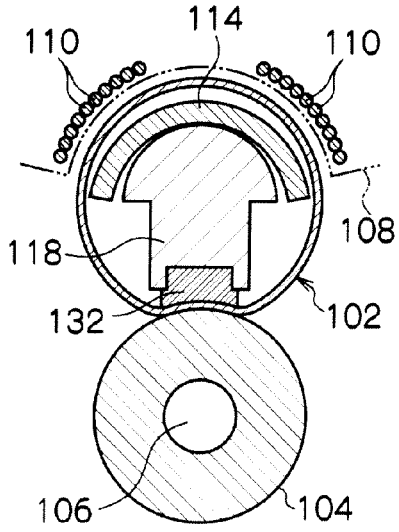
FIG. 6C and FIG. 6D are schematic drawings showing approaching separating states of the temperature-sensitive magnetic member relating to the first exemplary embodiment of the present invention.
Figure 6D:
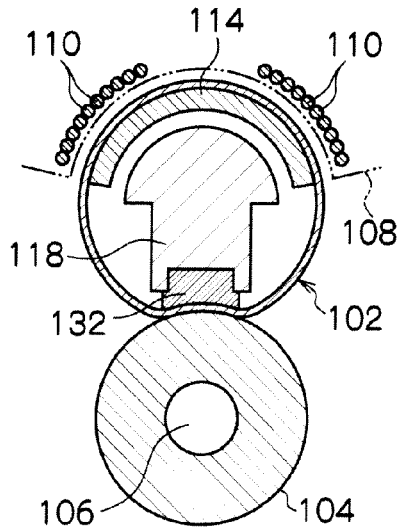

Here, as shown in FIG. 3B, FIG. 6B and FIG. 6D, when the temperature of the fixing belt 102 sensed at the thermistor 134 decreases and the temperature of the temperature-sensitive magnetic member 114 measured at the temperature sensor 135 has reached the reference set temperature (185° C. in the present exemplary embodiment), the control unit 50 operates the electric cylinders 178, 182 and draws in the cylinders 180, 184.

The flat plate portions 166A, 168A thereby move upward due to the return forces of the coil springs 174, 176, and the temperature-sensitive magnetic member 114 lightly contacts the inner peripheral surface of the fixing belt 102. Note that, if the temperature of the temperature-sensitive magnetic member 114 has not reached the reference set temperature, operation of the electric cylinders 178, 182 is not carried out until the temperature of the temperature-sensitive magnetic member 114 reaches the reference set temperature.

Next, the temperature (190° C.) of the temperature-sensitive magnetic member 114 becomes higher than the set fixing temperature (170° C.) and equilibrates, and the thermal energy that has accumulated at the temperature-sensitive magnetic member 114 is transferred toward the fixing belt 102. Due thereto, the temperature of the fixing belt 102 rises, and even if the second recording sheet P and recording sheets P thereafter are passed-through in succession, fixing at a temperature near the set fixing temperature is carried out.

Figure 7A:
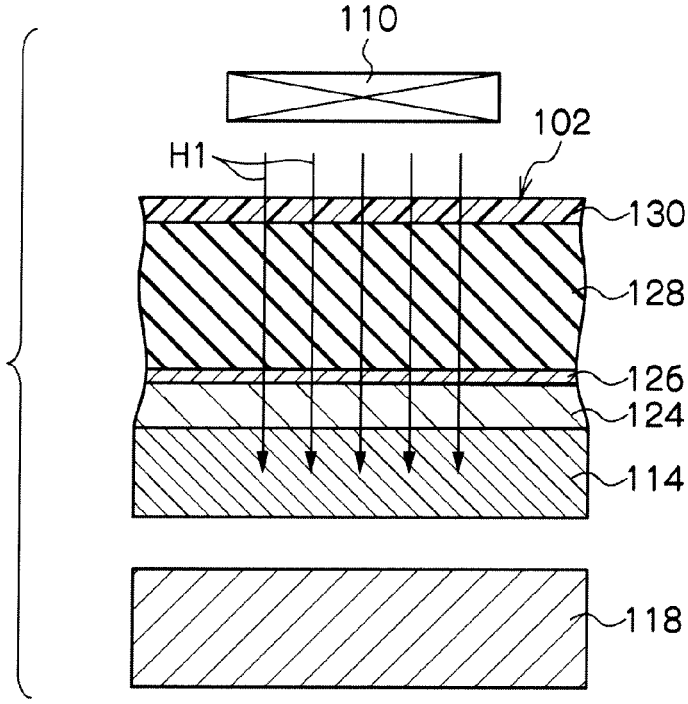
FIG. 7A and FIG. 7B are schematic drawings showing states in which a magnetic field passes-through the fixing belt and the temperature-sensitive magnetic member relating to the first exemplary embodiment of the present invention.
Figure 7B:
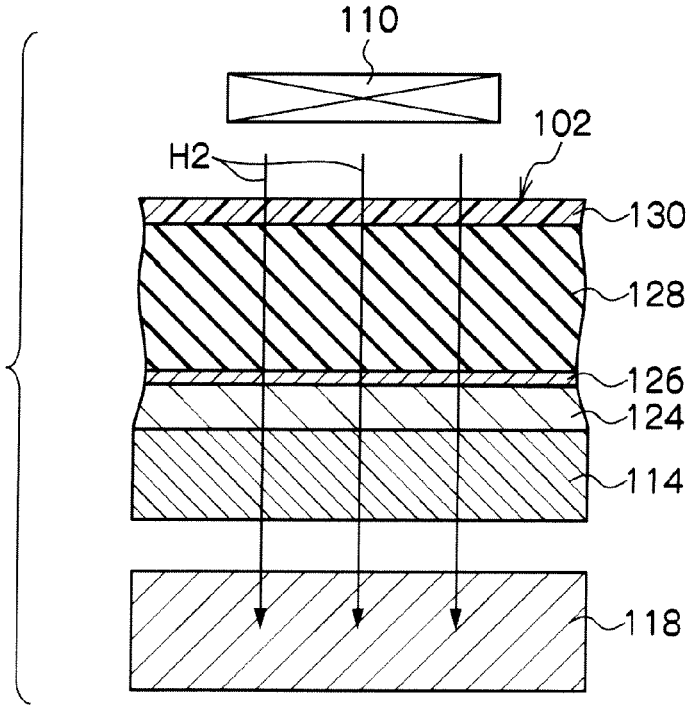

Next, operation of the temperature-sensitive magnetic member 114 in the state in which the temperature-sensitive magnetic member 114 contacts the fixing belt 102 will be described. FIG. 7A shows a case in which the temperature of the temperature-sensitive magnetic member 114 is less than or equal to the magnetic permeability change start temperature. FIG. 7B shows a case in which the temperature of the temperature-sensitive magnetic member 114 is greater than the magnetic permeability change start temperature.

As shown in FIG. 2A and FIG. 7A, in a case in which the temperature of the temperature-sensitive magnetic member 114 is less than or equal to the magnetic permeability change start temperature, because the temperature-sensitive magnetic member 114 is a strong magnetic body, a magnetic field H1 that increases the magnetic flux density and has passed-through the fixing belt 102 penetrates into the temperature-sensitive magnetic member 114 and forms a closed magnetic path, and the magnetic field H1 is strengthened. Due thereto, a sufficient heat generation amount of the heat generation layer 126 of the fixing belt 102 is obtained, and the temperature is raised to the predetermined set fixing temperature.

Figure 2B:
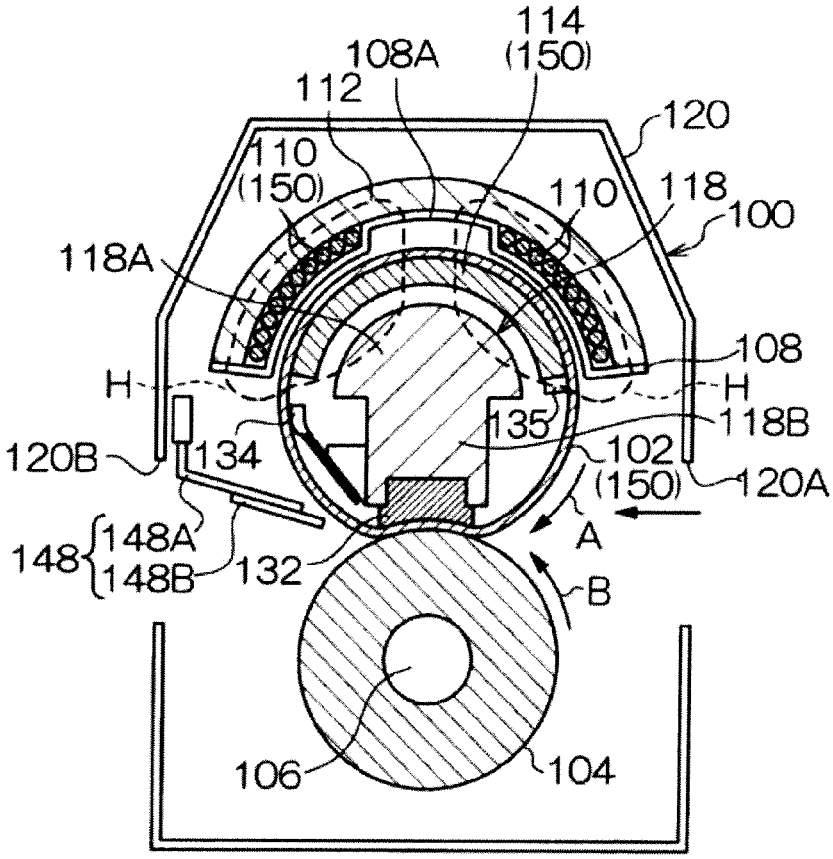
Figure 2C:
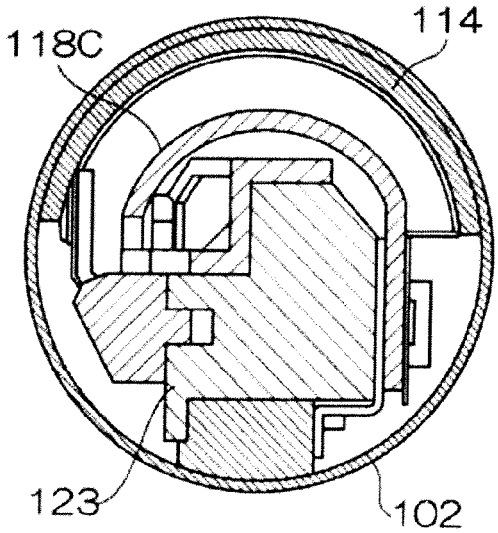
FIG. 2C is a cross-sectional view showing another example of the fixing device relating to the first exemplary embodiment of the present invention.

On the other hand, as shown in FIG. 2B and FIG. 7B, in a case in which the temperature of the temperature-sensitive magnetic member 114 is greater than or equal to the magnetic permeability change start temperature, the magnetic permeability of the temperature-sensitive magnetic member 114 decreases. Therefore, a magnetic field H2 that has passed-through the fixing belt 102 also passes-through the temperature-sensitive magnetic member 114 and heads toward the induction body 118. At this time, the magnetic flux density decreases and the magnetic field H2 weakens, and the magnetic field H2 can no longer easily pass-through and form a closed magnetic path. The magnetic flux reaches the induction body 118, and more of the eddy current flows to the induction body 118 than to the heat-generating layer 126 and the temperature-sensitive magnetic member 114. Therefore, the heat generation amount of the heat-generating layer 126 decreases.

As described above, the heat generation amount of the heat-generating layer 117 also decreases, and the heat generation amount of the temperature-sensitive magnetic member 114 also decreases. A rise in temperature of the fixing belt 102 that is greater than needed is thereby suppressed.

Figure 8:
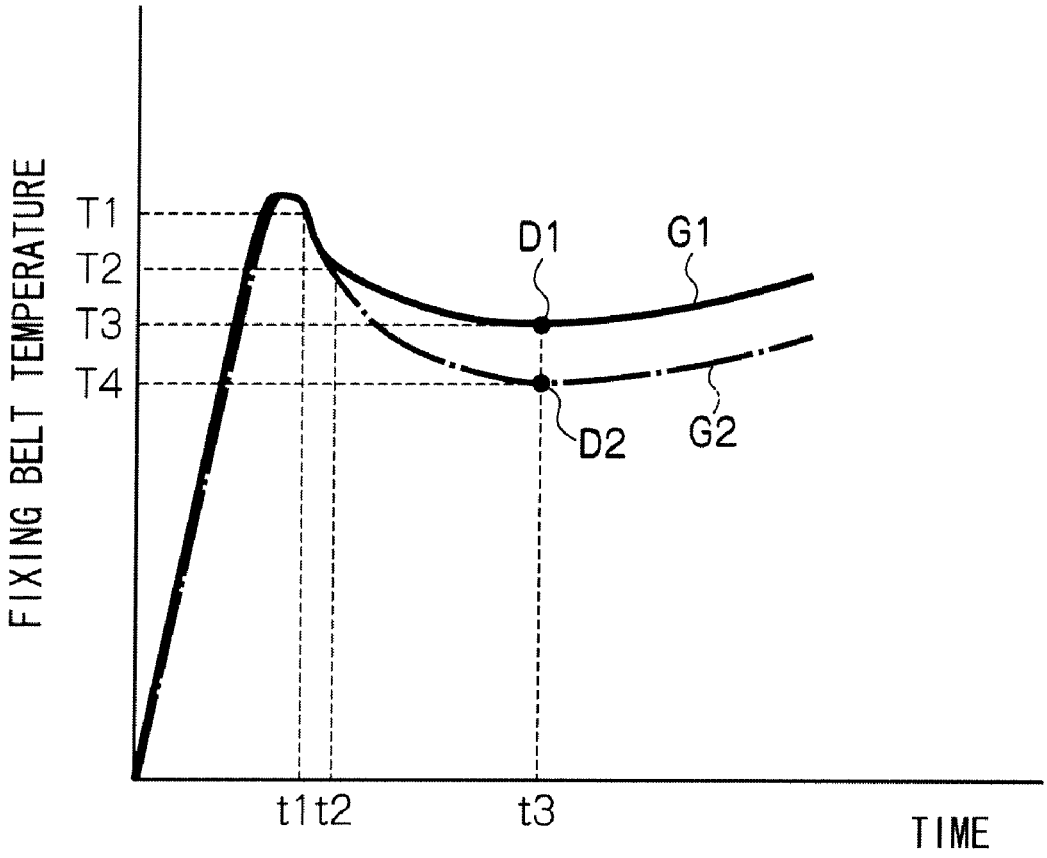
FIG. 8 is a graph showing the relationship between time and fixing belt temperature in the fixing device relating to the first exemplary embodiment of the present invention and in a comparative example.

The relationship between time (the time that has elapsed from start-up) and the temperature of the fixing belt 102 at the time when a plurality of the recording sheets P are fixed in succession, is shown in FIG. 8.

Graph G1 is the time-temperature curve of the fixing device 100 of the present exemplary embodiment. As a comparative example, graph G2 is the time-temperature curve at the time when a fixing device, in which the temperature-sensitive magnetic member 114 and the fixing belt 102 remain in the state of non-contact also after the fixing of the first sheet is completed, is used.

As shown in FIG. 2A and FIG. 8, in both graphs G1 and G2, during the time period up to time t1, the temperature of the fixing belt 102 is raised, and in the state in which the target set fixing temperature T1 is overshot slightly, the pressure roller 104 is made to contact the fixing belt 102. Due to the contact of the pressure roller 104, heat is robbed from the fixing belt 102, and therefore, the temperature falls to the set fixing temperature T1.

Next, during the time period from time t1 to time t2, the fixing of the first recording sheet P is carried out. At this time, in both the fixing device 100 and the fixing device of the comparative example, the temperature-sensitive magnetic member 114 and the fixing belt 102 are in a state of non-contact, and therefore, the supply of heat to the fixing belt 102 lags behind. Thus, the fixing belt 102, from which heat was robbed by the recording sheet P, falls to temperature T2 in a state in which the proportion of the temperature change is large.

Next, during the time period from time t2 to time t3, successive fixing of the recording sheets P from the second sheet on continues to be carried out.

In the fixing device 100 of the present exemplary embodiment, at the point in time that is time t2, the temperature-sensitive magnetic member 114 whose temperature is higher than that of the fixing belt 102 contacts the fixing belt 102, and therefore, heat is supplied from the temperature-sensitive magnetic member 114 to the fixing belt 102. Due thereto, in the drop in the temperature of the fixing belt 102 at the time of continuous fixing, the proportion of the change in temperature becomes small. Here, given that the lowest point of the temperature of the fixing belt 102 at the time of fixing is temperature droop (D), the fixing device 100 becomes temperature droop D1 (temperature T3) at time t3.

On the other hand, in the fixing device of the comparative example, also from time t2 on, the temperature-sensitive magnetic member 114 is in a state of not contacting the fixing belt 102, and therefore, hardly any supplying of heat from the temperature-sensitive magnetic member 114 to the fixing belt 102 is carried out. Therefore, at time t3, the temperature drops to temperature droop D2 (temperature T4 (<temperature T3)).

A second exemplary embodiment of the heating device of the present invention will be described next on the basis of the drawings. Note that parts that are basically the same as those of the above-described first exemplary embodiment are denoted by the same reference numerals as in the first exemplary embodiment, and description thereof is omitted.

Figure 9A:
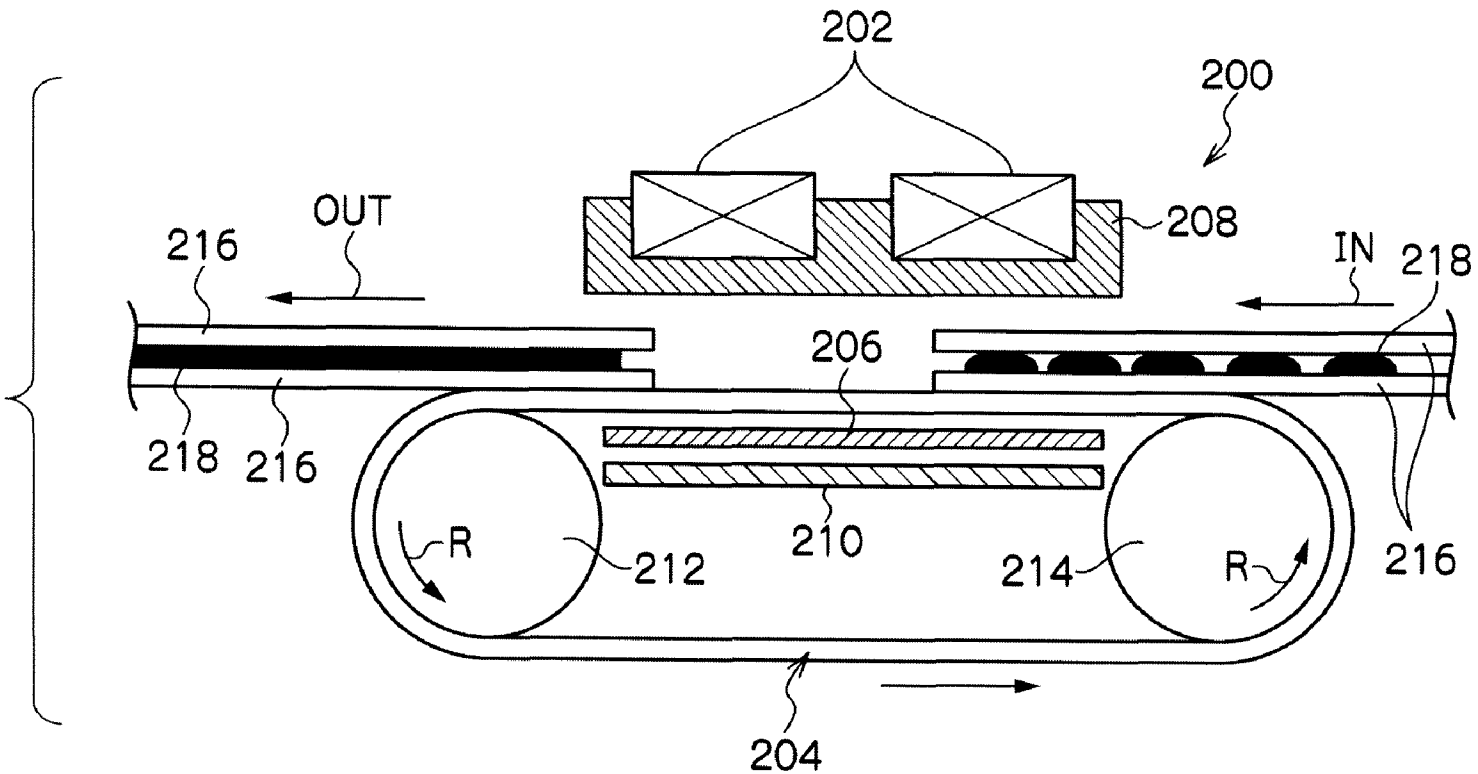
FIGS. 9A and 9B are cross-sectional views of a heating device relating to a second exemplary embodiment of the present invention.

A heating device 200 is shown in FIG. 9A. The heating device 200 has: an excitation coil 202 that is energized by an unillustrated energizing device and generates a magnetic field; a heating belt 204 disposed so as to face the excitation coil 202, and formed from a material and a layer structure that are similar to those of the above-described fixing belt 102 (see FIG. 2); and a temperature-sensitive magnetic member 206 formed from a material similar to that of the above-described temperature-sensitive magnetic member 114 (see FIG. 2), and disposed at the inner side of the heating belt 204 in a non-contact state. Further, a temperature sensor (not shown), that contacts the inner peripheral surface of the heating belt 204 and senses the temperature of the heating belt 204, is provided.

The excitation coil 202 is adhered and fixed to a resin bobbin 208 and is supported thereby. Further, the heating belt 204 is stretched around a pair of rollers 212, 214 that are rotatable, and at which the surface of a non-magnetic SUS (stainless steel) core metal is covered by a silicon rubber layer of a predetermined surface roughness (surface roughness such that the heating belt 204 is movable).

An unillustrated driving device such as gears, a motor and the like is connected to one of the rollers 212, 214. When the rollers 212, 214 rotate in the direction of arrow R due to the driving device, the heating belt 204 moves in the direction of the arrow. Note that the heating belt 204 may be formed substantially in the shape of a cylindrical tube, and gears may be adhered and fixed to the end portions thereof such that the heating belt 204 is driven directly.

The temperature-sensitive magnetic member 206 is formed in the shape of a flat plate. The above-described approaching/separating mechanism section 190 (see FIG. 5) is provided at the both end portions of the temperature-sensitive magnetic member 206 in the longitudinal direction (the direction perpendicular to the surface of the drawings of FIG. 9A and FIG. 9B). At the region where the temperature-sensitive magnetic member 206 faces the excitation coil 202, the temperature-sensitive magnetic member 206 can approach and move away from the inner peripheral surface of the heating belt 204. Further, an unillustrated temperature sensor is provided at the temperature-sensitive magnetic member 206, and a reference set temperature, that is higher than the set temperature of the heating belt 204, is set.

Operation of the approaching/separating mechanism section 190 is carried out on the basis of the output of the temperature sensor of the heating belt 204 and the output of the temperature sensor of the temperature-sensitive magnetic member 206. Here, when the heating belt 204 reaches the predetermined set temperature, and thereafter the temperature falls, and simultaneously, the temperature of the temperature-sensitive magnetic member 206 has reached the reference set temperature, the temperature-sensitive magnetic member 206 is made to contact the heating belt 204.

An induction body 210 is provided in a non-contact state at the side of the temperature-sensitive magnetic member 206 opposite the side at which the heating belt 204 is located. It suffices for the induction body 210 to be shaped as a flat plate, to be structured of the same material as the above-described induction body 118 (see FIG. 2), and to be a thickness that is greater than or equal to the skin depth. In the present example, aluminum of 1 mm is employed. The operation and control of the respective sections of the heating device 200 are carried out by a control unit that is similar to the above-described control unit 50 (see FIG. 1).

Operation of the second exemplary embodiment of the present invention will be described next. Note that, in the present exemplary embodiment, a case in which the heating device 200 is used in fusing and adhering will be described.

First, the excitation coil 202 is energized by the unillustrated energizing device, and a magnetic field is generated at the periphery of the excitation coil 202. In the same way as the above-described fixing belt 102, the heating belt 204 generates heat due to the working of electromagnetic induction by the magnetic field. Further, the heat-generating layer of the temperature-sensitive magnetic member 206 also generates heat due to the working of electromagnetic induction by this magnetic field.

Here, because the temperature-sensitive magnetic member 206 is disposed such that there is a gap between itself and the heating belt 204, it is difficult for the heat that is generated at the time of raising the temperature of the heating belt 204 to be transferred to the temperature-sensitive magnetic member 206. Due thereto, it is difficult for temperature-sensitive magnetic member 206 to rob heat from the heating belt 204, and the temperature of the heating belt 204 rises rapidly in a short time.

Next, at the heating device 200, the rollers 212, 214 are driven and rotate, and the heating belt 204 starts to move in the direction of the arrow. A pair of resin plates 216 are thereby transported to the heating device 200 (arrow IN). Note that an adhesive 218, that is a solid resin and fuses at a predetermined temperature, is sandwiched in advance between the pair of plates 216.

Next, the adhesive 218 is fused by the generation of heat of the heating belt 204, and spreads between the pair of plates 216. Due to the movement of the heating belt 204, the plates 216 are sent-out from the heating device 200 (arrow OUT). The pair of plates 216 that have been sent-out from the heating device 200 are adhered by the adhesive 218, that fused and spread, cooling and hardening.

Figure 9B:
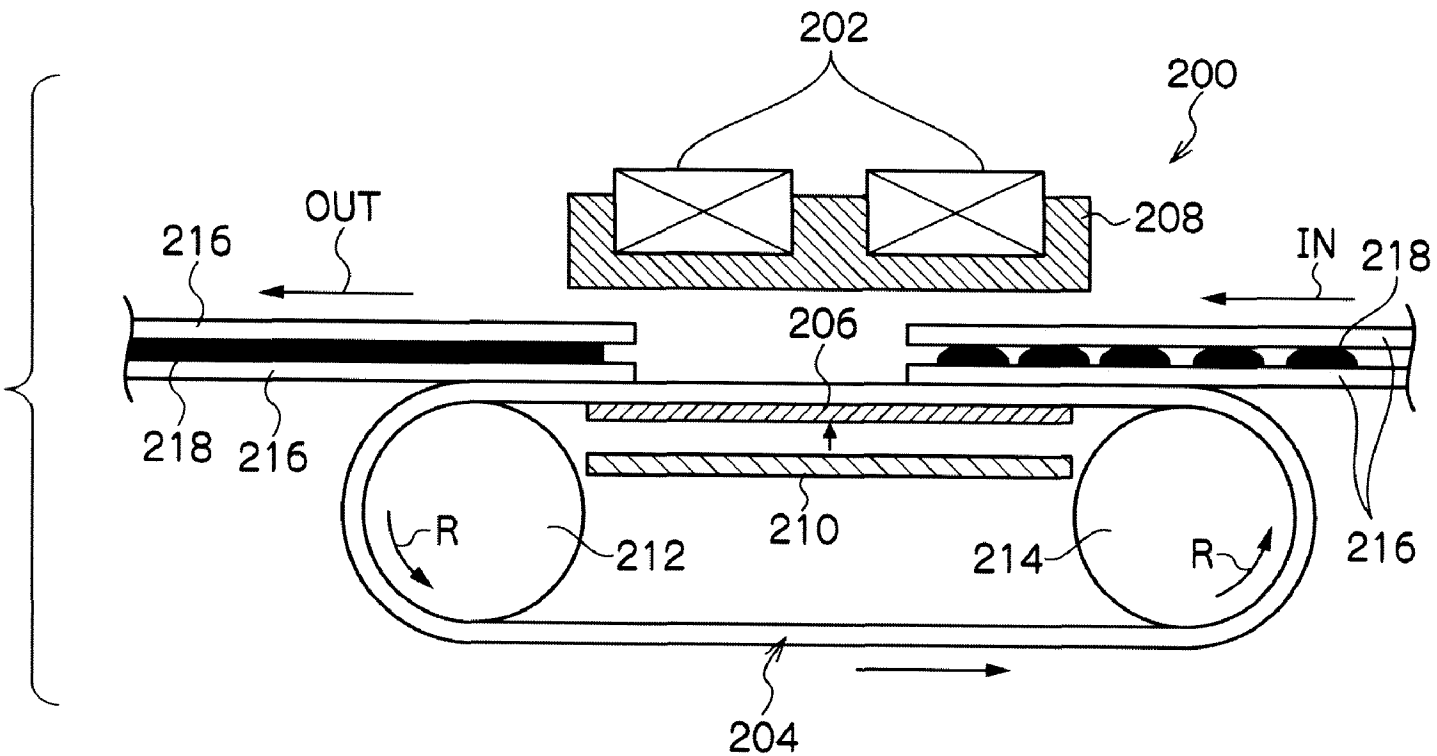

When the adhesion of the first set of plates 216 is finished, the temperature of the heating belt 204 drops to below the set temperature. Then, when the drop in temperature of the heating belt 204 is sensed by the unillustrated temperature sensor and the temperature of the temperature-sensitive magnetic member 206 reaches the reference set temperature, as shown in FIG. 9B, the approaching/separating mechanism section 190 raises the temperature-sensitive magnetic member 206 and makes it contact the inner peripheral surface of the heating belt 204.

Then, fusing and adhering of the plates 216 from the second set on continues to be carried out. Here, because the temperature-sensitive magnetic member 206 that is a higher temperature than the heating belt 204 contacts the heating belt 204, heat is supplied from the temperature-sensitive magnetic member 206 to the heating belt 204. Due thereto, in the drop in temperature of the fixing belt 204 at the time of continuous fusing and adhering, the proportion of the change in temperature becomes small.

A third exemplary embodiment of a heating device, a fixing device and an image forming device of the present invention will be described next on the basis of the drawings. Note that parts that are basically the same as those of the above-described first exemplary embodiment are denoted by the same reference numerals as in the first exemplary embodiment, and description thereof is omitted.

Figure 10:
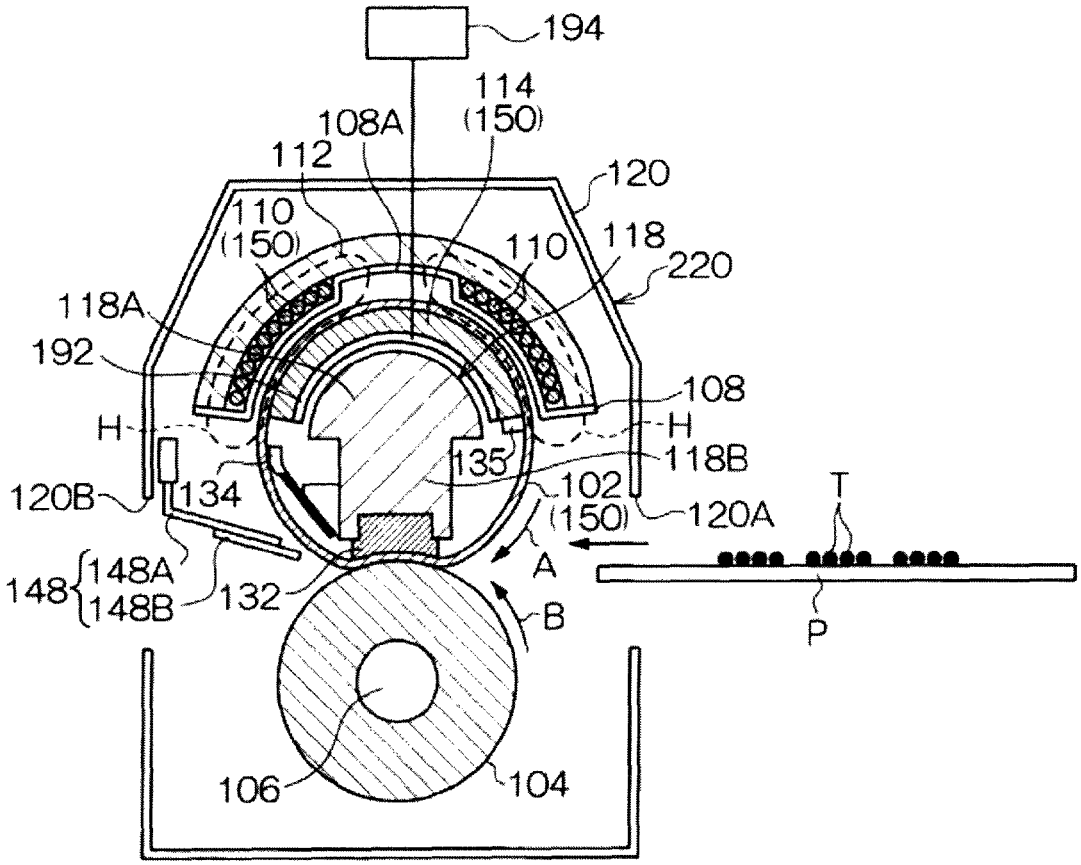
FIG. 10 is a cross-sectional view of a fixing device relating to a third exemplary embodiment of the present invention.

A fixing device 220 is illustrated in FIG. 10. The fixing device 220 is structured by a heat-generating body 192, that serves as a second heating source, and an electricity storage section 194, that is connected to the heat-generating body 192 and supplies electric power thereto, being provided at the fixing device 100 (see FIG. 2) of the above-described printer 10. Note that the excitation coil 110 is the first heating source.

The heat-generating body 192 is formed from a planar heat-generating body that is formed such that the transverse direction cross-section thereof is arc-shaped, and contacts the entirety of the inner peripheral surface of the temperature-sensitive magnetic member 114 (the surface at the side opposite the side where the fixing belt 102 is located). Further, the heat-generating body 192 generates heat due to predetermined electric power that is supplied from the electricity storage section 194, and heats the temperature-sensitive magnetic member 114.

On the other hand, the electricity storage section 194 has at the interior thereof an electricity storage device that is formed from a battery or a capacitor or the like, and charging thereof is carried out appropriately from an unillustrated power source of the printer 10 other than at times of fixing. The electricity storage section 194 is on/off controlled by the control unit 50 of the printer 10. During the time period until the temperature of the temperature-sensitive magnetic member 114 becomes greater than or equal to the reference set temperature that is set in advance, the electricity storage section 194 carries out energization of the heat-generating body 192 as needed.

Operation of the third exemplary embodiment of the present invention will be described next.

First, at times of operation of the printer 10 other than times of fixing, charging of the electricity storage section 194 is carried out from the unillustrated power source. Then, the energizing circuit 142 is driven on the basis of an electric signal from the control circuit 138, and AC current is supplied to the excitation coil 110. Due to the working of the electromagnetic induction of the magnetic field H generated at the excitation coil 110, the heat-generating layer 126 (see FIG. 3A) generates heat, and the fixing belt 102 is heated.

On the other hand, the temperature-sensitive magnetic member 114 is in a state of being apart from the fixing belt 102, and the heat-generating layer 117 (see FIG. 4A) generates heat due to the working of the electromagnetic induction of the magnetic field H. At this time, energization of the heat-generating body 192 from the electricity storage section 194 is carried out by the control unit 50, and the heat-generating body 192 generates heat. Due thereto, the temperature of the temperature-sensitive magnetic member 114 is raised rapidly due to the generation of heat of the heat-generating layer 117 and the generation of heat of the heat-generating body 192, and the temperature-sensitive magnetic member 114 reaches the reference set temperature.

Then, after the temperature of the temperature-sensitive magnetic member 114 reaches the reference set temperature, the temperature-sensitive magnetic member 114 contacts the fixing belt 102. The temperature (190° C.) of the temperature-sensitive magnetic member 114 is higher than the set fixing temperature (170° C.) and is in an equilibrium state, and the thermal energy accumulated at the temperature-sensitive magnetic member 114 is transferred toward the fixing belt 102. The temperature of the fixing belt 102 thereby rises, and, even if the recording sheets P from the second sheet on are passed-through in succession, fixing is carried out at a temperature neat the set fixing temperature.

Here, the power source of the printer 10 that carries out energization of the excitation coil 110 that serves as the first heating source, and the electricity storage section 194 that carries out energization of the heat-generating body 192 that serves as the second heating source, carry out energization independently. Therefore, the fixing device 220 is w-armed-up rapidly without placing a burden on the power source of the printer 10.

Note that the present invention is not limited to the above-described exemplary embodiments.

The printer 10 does not have to be a dry-type electrophotographic printer using a solid developer, and may use a liquid developer. Further, a thermocouple may be used instead of the thermistor 134 as the sensor for sensing the temperature of the fixing belt 102.

The position of mounting the thermistor 134 is not limited to the inner peripheral surface of the fixing belt 102, and the thermistor 134 may be mounted to the outer peripheral surface side of the fixing belt 102. In this case, a non-contact-sensing-type temperature sensor is used. Further, if conversion of the temperature is set in advance, the thermistor 134 may be mounted to the surface of the pressure roller 104.

Judgment of the timing at which the temperature-sensitive magnetic member 114 is made to contact the fixing belt 102 is not limited to judging by directly measuring the temperature of the temperature-sensitive magnetic member 114 by the temperature sensor 135. Judgment may be carried out by, for example, counting the number of the recording sheets P that are sent into the fixing device 100, or on the basis of the time that has elapsed from the start of energization of the excitation coil 110.

The temperature-sensitive magnetic member 114 may be structured by a material that is only a single type of temperature-sensitive layer at which it is easy for eddy current to flow.

Other than the electric cylinders 178, 182, a swinging mechanism using a cam and a bracket may be used at the approaching'separating mechanism 190. Further, other than being used for fusing and adhering, the heating device 200 may also be used as a drier.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The exemplary embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A heating device comprising:

a magnetic field generating unit that generates a magnetic field;

a heat-generating member that is disposed so as to face the magnetic field generating unit, and generates heat due to electromagnetic induction of the magnetic field, and has a heat-generating layer of a thickness that is thinner than a skin depth;

a temperature-sensitive member that is disposed so as to face a side of the heat-generating member opposite a side at which the magnetic field generating unit is located, and generates heat due to electromagnetic induction of the magnetic field, and includes a temperature-sensitive magnetic member whose magnetic permeability starts to decrease continuously from a magnetic permeability change start temperature that is in a temperature region that is greater than or equal to a set temperature and less than or equal to a heat-resistant temperature; and an approaching/separating mechanism that maintains the temperature-sensitive member in a state of being separated from the heat-generating member until before a temperature of the temperature-sensitive member reaches the set temperature, and causes the temperature-sensitive member to contact the heat-generating member at and after the time when the temperature-sensitive member reaches the set temperature.

2. The heating device of claim 1, further comprising a temperature sensor that senses the temperature of the temperature-sensitive member, wherein, when the temperature of the temperature-sensitive member that is sensed by the temperature sensor has not reached a predetermined set temperature, the approaching/separating mechanism does not cause the temperature-sensitive member to contact the heat-generating member.

3. The heating device of claim 1, further comprising a first heating source that includes the magnetic field generating unit, and a second heating source that heats the temperature-sensitive member and is different from the magnetic field generating unit, wherein the second heating source heats the temperature-sensitive member during a time period until the temperature of the temperature-sensitive member reaches a temperature that is greater than or equal to the set temperature.

4. The heating device of claim 3, wherein the second heating source is a planar heat-generating body disposed at a side of the temperature-sensitive member opposite a side at which the magnetic field generating unit is located.

5. The heating device of claim 3, further comprising an electricity storage unit that supplies electric power to the second heating source.

6. The heating device of claim 1, wherein a non-magnetic metal layer is disposed at a surface of the temperature-sensitive magnetic member which surface is at a side opposite a side at which the magnetic field generating unit is located.

7. The heating device of claim 1, further comprising an induction body that includes a non-magnetic metal and that induces magnetic flux so as to form a closed magnetic path at a side of the temperature-sensitive magnetic member opposite a side at which the magnetic field generating unit is located.

8. A fixing device comprising:

the heating device of claim 1, wherein the heat-generating member is a fixing rotating body whose both end portions are rotatably supported, and the fixing device further comprises a pressure-applying rotating body that contacts an outer peripheral surface of the fixing rotating body and fixes a developer image, that is on a recording medium passing between the pressure-applying rotating body and the fixing rotating body, to the recording medium.

9. An image forming device comprising:

the fixing device of claim 8;

an exposure section that emits exposure light;

a developing section that develops a latent image, that is formed by the exposure light, by a developer so as to form a developer image;

a transfer section that transfers the developer image, that is developed at the developing section, onto a recording medium; and a transporting section that transports the recording medium, onto which the developer image is transferred at the transfer section, to the fixing device.

10. A heating device comprising:

a magnetic field generating unit that generates a magnetic field, a heat-generating member that is disposed so as to face the magnetic field generating unit, and generates heat due to electromagnetic induction of the magnetic field, and has a heat-generating layer through which the magnetic field passes;

a temperature-sensitive member that is disposed so as to face a side of the heat-generating member opposite a side at which the magnetic field generating unit is located, and generates heat due to electromagnetic induction of the magnetic field, and includes a temperature-sensitive magnetic member whose magnetic permeability decreases continuously from a predetermined temperature; and an approaching separating mechanism that maintains the temperature-sensitive member in a state of being separated from the heat-generating member until before a temperature of the temperature-sensitive member reaches a set temperature, and causes the temperature-sensitive member to contact the heat-generating member at and after the time when the temperature-sensitive member reaches the set temperature.

11. The heating device of claim 10, wherein the predetermined temperature is a magnetic permeability change start temperature in a temperature region that is greater than or equal to the set temperature and less than or equal to a heat-resistant temperature.

12. The heating device of claim 10, further comprising a first heating source that includes the magnetic field generating unit, and a second heating source that heats the temperature-sensitive member and is different from the magnetic field generating unit, wherein the second heating source heats the temperature-sensitive member during a time period until the temperature of the temperature-sensitive member reaches a temperature that is greater than or equal to the set temperature.

13. The heating device of claim 12, wherein the second heating source is a planar heat-generating body disposed at a side of the temperature-sensitive member opposite a side at which the magnetic field generating unit is located.

14. The heating device of claim 12, further comprising an electricity storage unit that supplies electric power to the second heating source.

15. The heating device of claim 10, wherein a non-magnetic metal layer is disposed at a surface of the temperature-sensitive magnetic member which surface is at a side opposite a side at which the magnetic field generating unit is located.

16. The heating device of claim 10, further comprising an induction body that includes a non-magnetic metal and that induces magnetic flux so as to form a closed magnetic path at a side of the temperature-sensitive magnetic member opposite a side at which the magnetic field generating unit is located.

17. A fixing device comprising:

the heating device of claim 10, wherein the heat-generating member is a fixing rotating body whose both end portions are rotatably supported, and the fixing device further comprises a pressure-applying rotating body that contacts an outer peripheral surface of the fixing rotating body and fixes a developer image, that is on a recording medium passing between the pressure-applying rotating body and the fixing rotating body, to the recording medium.

18. An image forming device comprising:

the fixing device of claim 17;

an exposure section that emits exposure light;

a developing section that develops a latent image, that is formed by the exposure light, by a developer so as to form a developer image;

a transfer section that transfers the developer image, that is developed at the developing section, onto a recording medium; and a transporting section that transports the recording medium, onto which the developer image is transferred at the transfer section, to the fixing device.

* * * * *